US006736453B2

(12) United States Patent
Chambers et al.

(10) Patent No.: US 6,736,453 B2
(45) Date of Patent: May 18, 2004

(54) STRETCH SLIPCOVERS

(75) Inventors: Jeffrey A. Chambers, Hockessin, DE (US); John Gorcyca, Kennett Square, PA (US); Geoffrey D. Hietpas, Newark, DE (US)

(73) Assignee: E. I. du Pont de Nemours and Co., Wilmington, DE (US)

( * ) Notice: Subject to any disclaimer, the term of this patent is extended or adjusted under 35 U.S.C. 154(b) by 0 days.

(21) Appl. No.: 10/007,578

(22) Filed: Dec. 5, 2001

(65) Prior Publication Data

US 2003/0122411 A1 Jul. 3, 2003

(51) Int. Cl.[7] ..... A47C 31/00

(52) U.S. Cl. ..... 297/228.1; 442/182

(58) Field of Search ..... 5/496, 497, 280; 2/49.1, 69.5, 115; 297/228.1, 224, 228, 228.11, 228.12, 228.13, 229, 219.1, 225, 218.1, 218.2, 218.5; 442/182, 184

(56) References Cited

U.S. PATENT DOCUMENTS

| | | | | |
|---|---|---|---|---|
| 3,227,511 A | | 1/1966 | Seltzer | |
| 3,671,379 A | | 6/1972 | Evans et al. | |
| 4,103,968 A | * | 8/1978 | Butterfield et al. | |
| 4,693,511 A | * | 9/1987 | Seltzer et al. | |
| 5,023,125 A | * | 6/1991 | Gray | |
| 5,150,947 A | * | 9/1992 | Croshaw | 297/229 |
| 5,234,252 A | * | 8/1993 | Wallach | 297/229 |
| 5,320,407 A | | 6/1994 | Tell | |
| 5,549,355 A | | 8/1996 | Illulian | |
| 5,594,955 A | * | 1/1997 | Sommers | 2/114 |
| 5,647,842 A | * | 7/1997 | Kininmonth et al. | 602/76 |
| 5,664,832 A | | 9/1997 | Stevens et al. | |
| 5,690,380 A | | 11/1997 | Waters | |
| 5,709,431 A | * | 1/1998 | Horn | 297/228.1 |
| 5,722,723 A | | 3/1998 | Riley et al. | |
| 6,067,777 A | * | 5/2000 | Stoll | |
| 6,116,685 A | | 9/2000 | White et al. | |
| 6,125,515 A | * | 10/2000 | Bolick et al. | 28/190 |
| D444,982 S | * | 7/2001 | LaConte | |
| 6,272,701 B1 | | 8/2001 | Zafiroglu | |
| 6,279,993 B1 | | 8/2001 | Berthiaume | |
| 6,279,999 B1 | | 8/2001 | Lee et al. | |
| D458,073 S | * | 6/2002 | Spitzer | D6/611 |

FOREIGN PATENT DOCUMENTS

| | | |
|---|---|---|
| DE | 2829873 A | 1/1980 |
| EP | 08531528 A1 | 7/1998 |
| FR | 1516950 | 2/1968 |
| FR | 2777760 | 10/1999 |
| GB | 1313173 | 4/1973 |

* cited by examiner

*Primary Examiner*—Peter M. Cuomo
*Assistant Examiner*—Stephen Vu
(74) *Attorney, Agent, or Firm*—Robert B. Furr, Jr.

(57) ABSTRACT

Upholstery stretch slipcovers are constructed from fabric having sufficient elastic recovery force so that the covers require no additional fabric to hold the slipcovers in place or to maintain a substantial absence of wrinkles in the slipcovers. The stretch slipcovers are particularly useful for chairs having separate back and seat cushions.

4 Claims, 4 Drawing Sheets

STRETCH SLIPCOVERS

BACKGROUND OF THE INVENTION

1. Field of the Invention

The present invention relates to furniture slipcovers.

2. Description of Background Art

The replacement of furniture upholstery for the purpose of either replacing soiled fabric or change of decor is often desired. Pre-fabricated slipcovers represent a relatively inexpensive alternative to the custom re-upholstery of furniture or to the construction of custom slipcovers that are uniquely designed for one particular piece of furniture. Previous pre-fabricated slipcover designs, while inexpensive, have been characterized by a variety of significant shortcomings.

U.S. Pat. No. 5,690,380 describes a one-piece slipcover, supplemented by optional, interchangeable trim components, intended for lightweight folding or non-folding chairs. The material used is a non-stretch fabric and methods for securing the cover to the chair, including ties, straps, pockets to engage the seat pan, etc. The cover is designed to give a loose, draped appearance and does not in any way simulate a custom fitted design. An additional problem is that while the fabric may be anchored at several fixed locations on the chair, the overall loose fit allows the fabric to become disheveled when the occupant of the chair shifts position. This shifting can cause distortion and mis-registry of the fabric pattern on the chair.

Various designs of one-piece covers have been disclosed for sofas and chairs for which there is no intervening space between the back and seat surfaces. Such designs claim the ability to provide a somewhat more fitted appearance than the draped type of slipcover. For example, U.S. Pat. No. 5,549,355 describes a cover that provides a "fitted" look by incorporating a plurality of elastic bands stitched into particular locations around the periphery of the cover. These bands provide an inwardly directed force pulling the fabric close to the underlying furniture when the cover is in place. The fabric itself is not extensible, and additional elastic bands are stitched into the cover at desired locations to cause the excess fabric to form "gathers" or folds. Thus the "fitted" look is achieved by attempting to artfully arrange the excess fabric that does not closely conform to the underlying furniture. The non-extensible nature of the fabric and the resulting loose folds still present the problem of significant portions of the fabric being able to slide across the back or seat surfaces when the occupant moves. U.S. Pat. No. 6,116,685 provides a design that offers similar attributes, but attempts to provide a somewhat improved fit and anchoring system by utilizing pairs of binding elements, such as cords, rope, ribbon, or straps at the corners of the furniture to further secure the slipcover. This design, however, also relies on the excess fabric being tucked into crevices (e.g. between the back and seat and between the arms and seat). Thus, the fabric is not completely secure.

Other means for dealing with excess amounts of non-extensible fabric in these pre-fabricated, non-custom slipcovers have been reported. U.S. Pat. No. 5,722,723 discloses elongated, V-shaped members that expand when wedged into crevices thereby stabilizing the position of the slipcover on the furniture. U.S. Pat. No. 5,320,407 employs telescopically compressible channels of material, aligned with the seams of a slipcover, with cinching cords running through the channels.

None of the above mentioned designs achieves the fitted look characterizing re-upholstered furniture or custom slipcover designs. They all exhibit the problems of imperfectly secured covers and, to varying extents, suffer from relatively complex constructions and difficult installation.

Extensible fabrics offer the potential for addressing some of the shortcomings exhibited by slipcover designs of the type thus far described. Great Britain Patent 1,300,582 has disclosed one-piece "loose covers" designed for use on armchairs or sofas, wherein the cover is made from elastic fabric, such as fabric knitted with permanently crimped yarns. While the stretch characteristics of the fabric contribute to a closer conforming cover, an elastic band, such as one made from rubber yarn and having greater elasticity than the fabric, must be incorporated into the cover to restrain the cover from shifting position.

U.S. Pat. No. 3,227,511 discloses woven stretchable fabrics that may be used for applications including upholstery material. The yarns used to make these fabrics are inherently non-stretchable, such as cotton or rayon. The fabric woven from these yarns can be made to exhibit stretch behavior by: i) suitably treating the fabric, as by a strong contracting and swelling agent and ii) treating the fabric, while in the contracted state, with a thermosetting or thermoplastic resins. The first step reduces the dimensions of the fabric in at least one direction, such that crimp is imparted to the yarns running parallel to that direction. The second step maintains the yarns in their crimped condition and thereby imparts some recoverability to the fabric to return it to an unstretched condition following any stretching. The complex manufacturing methods described appear to be primarily suited for producing fabrics with unidirectional stretch characteristics, and where such fabrics will stretch within the range of 15 to 50% in the direction parallel to the crimped yarns.

European Patent 0 853 1528 A1 discloses a process for preparing a fabric extensible in both the warp and the weft direction, for use as a seat cover. Fabrics are manufactured from synthetic yarns that have received a false twist texturing treatment rendering them extensible. Fabrics exhibiting extensibility on the order of 20% are disclosed.

U.S. Pat. No. 3,671,379 discloses bicomponent polyester fibers that exhibit significant stretch and recovery characteristics. Slipcovers are among the listed uses for fabrics containing such fibers.

U.S. Pat. No. 6,272,701 to Zafiroglu discloses a mattress cover with a skirt having an elastic lower edge. U.S. Pat. No. 6,279,999 to Lee et al. discloses an automotive seat cover having heat-shrinkable lower edge panels.

None of the above-cited prior art discloses a slipcover that exhibits a fitted appearance emulating that achieved by custom re-upholstery.

SUMMARY OF THE INVENTION

The invention provides a stretch slipcover for a resilient cushion, the stretch slipcover having a top and sides comprising a first fabric having sufficient elastic recovery force that the stretch slipcover requires no second fabric having greater elasticity than the first fabric to maintain the substantial absence of surface wrinkles in normal use.

In a preferred embodiment, the stretch slipcover of the invention exerts an elastic recovery force that is sufficient to hold the stretch slipcover in place for normal use. The stretch slipcover of the invention may include a separate elastic band affixed to the perimeter of said stretch slipcover for gripping the resilient cushion, but such perimeter band is not required. In a preferred embodiment, the stretch slipcover of the invention includes no separate elastic or resilient band around the perimeter of the stretch slipcover.

In a second embodiment, the invention provides a stretch slipcover having a top panel and side panels comprising fabric having greater than 30% extension, at 15 lbs. applied load, in directions parallel and perpendicular to the warp direction and a minimum recovery force of 200 grams at 25% extension in directions parallel and perpendicular to the warp direction. The stretch slipcover requires no elastic band around the perimeter of said stretch slipcover having greater elasticity than said fabric. In a preferred embodiment, the stretch slipcover requires no resilient band around the perimeter of said stretch slipcover.

In a third embodiment, the invention provides a stretch slipcover set comprising:

a) a back cover having front and side portions for covering the back cushion of a chair; and b) a seat cover comprising top and side portions for covering a chair seat;

wherein said covers comprise fabric having greater than 30% extension, at 15 lbs. applied load, in directions parallel and perpendicular to the warp direction and a minimum recovery force of 200 grams at 25% extension in directions parallel and perpendicular to the warp direction.

DETAILED DESCRIPTION OF THE INVENTION

Figure 1:
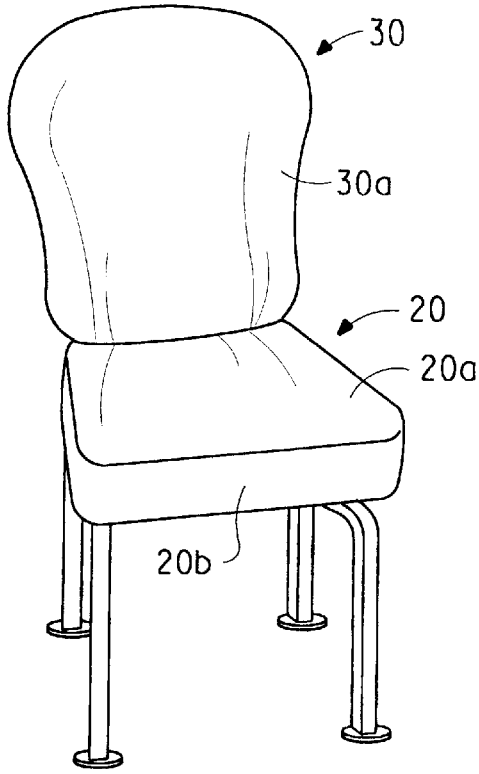
FIG. 1 is a perspective view of a chair having separate back and seat cushions.

The stretch slipcovers of the present invention are especially useful on chairs having separate back and seat cushions. The separate back and seat cushion surfaces are separated by an intervening space, thereby enabling each surface to be covered with its own stretch slipcover. However, the stretch slipcovers of the invention can be used, more generally, on seating devices that are supported by a base or a plurality of legs and further comprised of either a seating surface only or a seating surface and a back-support surface, where such surfaces, if both types are present, are separated by an intervening space. Included in such seating devices are chairs having no arms; chairs with arms and where there is also intervening space between the arms and the back and between the arms and the seat; and stools or benches comprised of a seating surface and legs (but no back-support). Examples of suitable office chairs for use with the stretchcovers of the present invention include Steelcase® brand chairs having separate seat and back cushions such as "a la carte®", Sweeper series Unv®, Alby®, Leap® and Equa® models available from Steelcase®, Inc. 901 44$^{th}$ Street SE, Grand Rapids, Mich. 49508. Additional examples include Herman Miller® brand office chair models such as Ambi®, Ergon 3®, available from Herman Miller, Inc., 855 East Main Avenue, P.O. Box 302, Zeeland, Mich. 49464-0302.

Fasteners, such as those made of Velcro® brand hook and loop fasteners, may be optionally employed to facilitate securing the stretch slipcovers to the seating device being covered. However, the seating device designs to which the stretch slipcovers disclosed hereunder are applicable do not generally require such additional fastening devices.

In one embodiment, the stretch slipcovers of the invention require no additional elastic band around the perimeter of the stretch slipcover to hold the stretch slipcover in place. Thus the stretch slipcovers of the invention may be fabricated absent an elastic band having greater elasticity than the fabric itself. In another embodiment, the stretch slipcovers of the invention require no substantially inelastic band or drawstring around the perimeter of the stretch slipcover to hold the stretch slipcover in place.

The stretch slipcovers of the present invention can be advantageously employed on any chair fitting the description given above. However, this invention is particularly useful in commercial settings, where chairs of a single design are typically purchased in large numbers by individual users. Such users may include hotels, convention halls and proprietors of other venues where large groups of people must be continually accommodated. In such commercial settings, furniture is subjected to unusually hard wear, soiling and general abuse. A need exists to provide a relatively inexpensive means of replacing damaged or soiled fabric on such chairs, stools and benches and to be able to effect such a replacement easily and quickly.

In some instances, a change of fabric is desired, not because of deteriorated condition, but simply because a change in decor is preferred. Banquet facilities would benefit from being able to change and coordinate chair fabrics along with tablecloths and napkins. For example, chairs could be easily customized with personalized insignia for specific events. The stretch slipcovers of the invention can be installed and used without causing distortion and misregistry of the pattern. The highly shape-conforming stretch slipcovers of this invention enable the use of such patterned fabrics, and are of special value in situations where the aesthetic aspects of interior design are of prime consideration. For instance, the stripes in a striped fabric of the invention will conform to the shape of the resilient underlying material such as a chair cushion.

This invention provides stretch slipcovers that are relatively inexpensive, can be easily and rapidly changed, maintain positional stability when in use, and conform to the underlying chair or seating device, in size and shape, to yield a custom-fitted appearance when installed. The stretch slipcover fabric must be extensible and, furthermore, must exhibit adequate levels of two necessary properties: stretch and stretch recovery. The characteristics enable the stretch slipcovers of the present invention, while not custom fabricated, to fit a range of chairs of similar, yet different, designs, shapes and sizes.

As used herein, "extensible" means the ability of a fabric to be extended, in one or more directions, beyond its corresponding equilibrium dimensions. As used herein, "stretch" refers to fiber, yarn, or fabric characterized by greater than normal capacity for extension and recovery from extension. The term "stretch" (according to *Textile Terms and Definitions,* 10$^{th}$ Edition, The Textile Institute, 1997) is ". . . used for materials with greater extension and recovery properties than traditional woven or knitted structures from conventional yarns . . . ". As used herein, the adjective "substantially inelastic" means that the modified term exhibits little or no stretch under an applied force that would cause measurable stretch in a material referred to herein as "elastic".

The extensible fabric suitable for use in the present invention preferably comprises spandex fiber, more preferably Lycra® brand fiber commercially available from E. I. du Pont de Nemours and Company of Wilmington, Del. As used herein "spandex" has its usual meaning, that is, a manufactured fiber in which the fiber-forming substance is a long chain synthetic elastomer comprised of at least 85% by weight of a segmented polyurethane.

Stretch slipcovers of the present invention must be constructed from fabric exhibiting bi-directional extension and recovery characteristics. Specifically, a minimum of 30% extension, at 15 lbs. applied load, in both the warp direction and the direction perpendicular to the warp and a minimum recovery force of 200 grams at 25% extension in both those directions are required. In the following examples are described specific fabrics that exemplify those fabric types that will satisfy the above stated criteria.

Stretch slipcovers made of fabrics that exhibit the minimum stretch and recovery characteristics required of the present invention are found to be especially useful for use on chairs where the dimensions of a surface may not be constant. As shown below in the Examples, a single stretch slipcover of the invention can fit the back cushion of either a banquet-type chair or an office-type chair. This is notable because the banquet-type chair may have a back cushion that is wider at the top than at the bottom, thus providing a constricted "waist" appearance. In contrast, the back cushion of an office chair may be wider at the bottom than at the top, thus providing a pear-shaped cross-section.

Stretch slipcovers of the type disclosed hereunder have adequate stretch allowing them to slide easily over the back-support surface, but have sufficient recovery force to provide excellent shape conformation. The stretch slipcovers can provide a smooth fit that is substantially free of wrinkles. An additional benefit is that the stretch slipcovers of the invention can be easily interchangeable among different shaped seat and back cushions, and can provide a high quality of fit despite the fact that identical covers are used for different chairs. The quality of fit between two different chairs can be indistinguishable for a given set of stretch slipcovers. The stretch slipcovers can also exhibit a striking and unanticipated lack of pattern distortion.

FIG. 1 shows a perspective view of a chair having a separate seat cushion and back cushion, covered by seat cushion stretch slipcover 20 and back cushion stretch slipcover 30, respectively. In the illustrated embodiment, both the front portion 20*a* of seat cushion 20 and the side panel 20*b* are fabricated from a material exhibiting bi-directional extension and recovery characteristics as described above.

Figure 2:
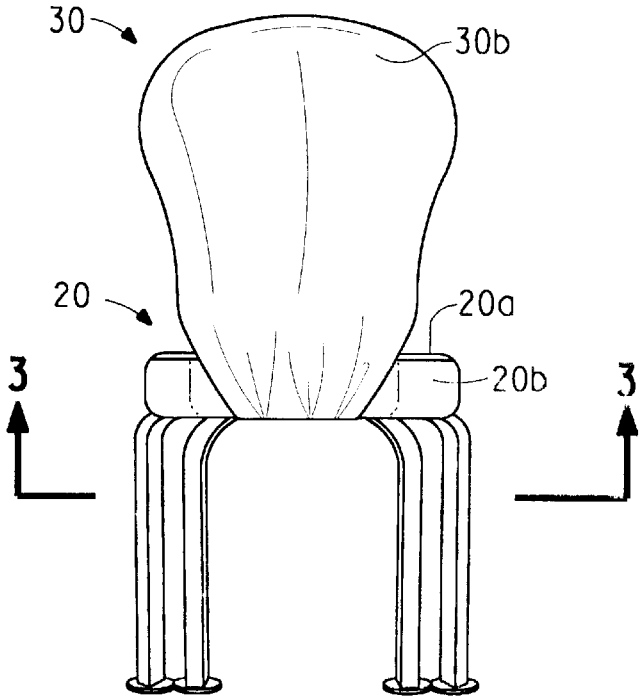
FIG. 2 is a back elevation of a chair having separate back and seat cushions and illustrating one embodiment of a stretch slipcover set in accordance with the present invention.

FIG. 2 shows a back elevation view of a chair having a separate seat cushion and back cushion. The back cushion stretch slipcover 30 includes a top portion 30*a* and a back portion 30*b*. The stretch slipcovers illustrated in FIGS. 1 and 2 are generally of the type characterized below in Tables 1 and 2.

FIG. 2 shows the appearance of one embodiment of a stretch slipcover of the invention that is fastened to the chair bottom as described below with reference to FIG. 3.

Figure 3:
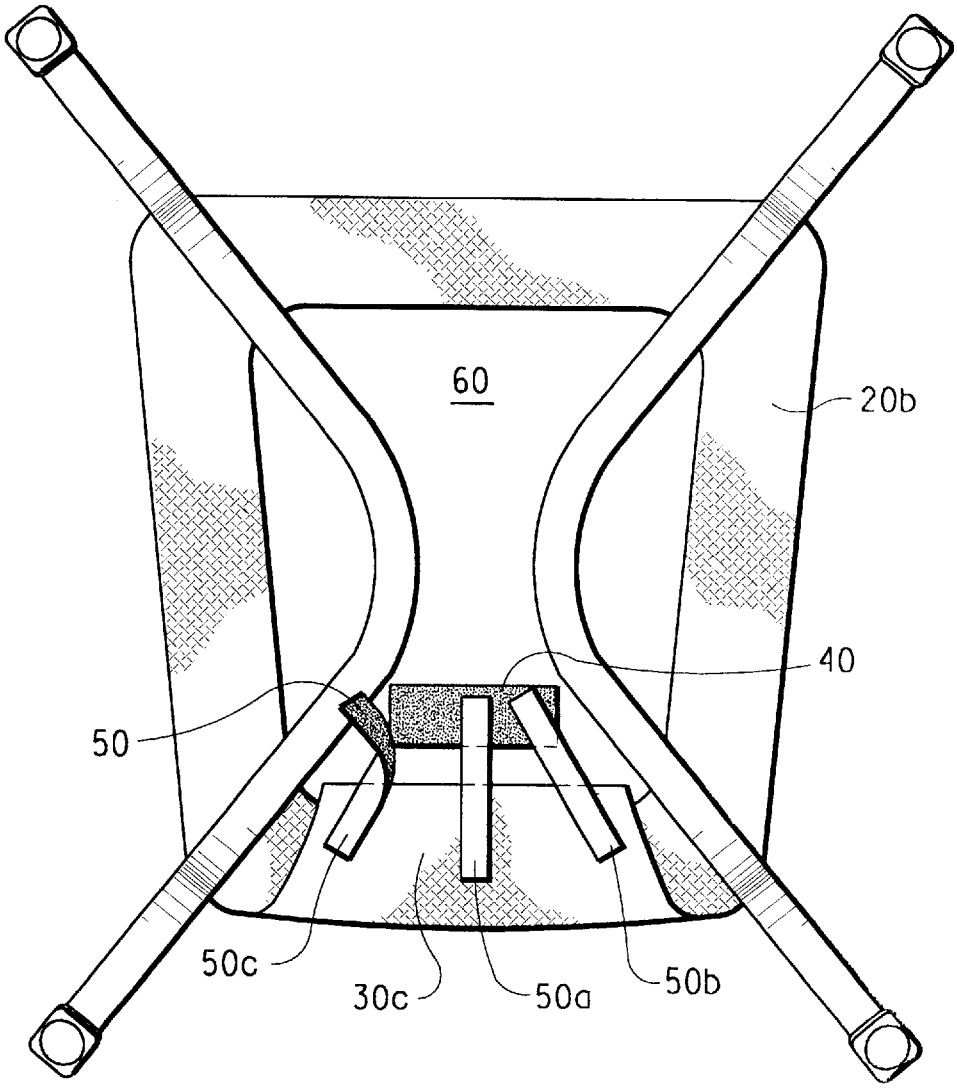
FIG. 3 is a plan view showing the bottom of a chair having separate back and seat cushions, showing a suitable means for fastening the stretch slipcover to the seat cushion.

FIG. 3 is a plan view of the bottom of a chair of the type illustrated in FIGS. 1 and 2. FIG. 3 shows the use of hook-and-loop fasteners (40, 50*a*, 50*b* and 50*c*) to anchor the lower back portion 30*c* of a back cushion stretch slipcover to the underside 60 of a seat cushion in a chair having separate resilient seat and back cushions.

Figure 4:
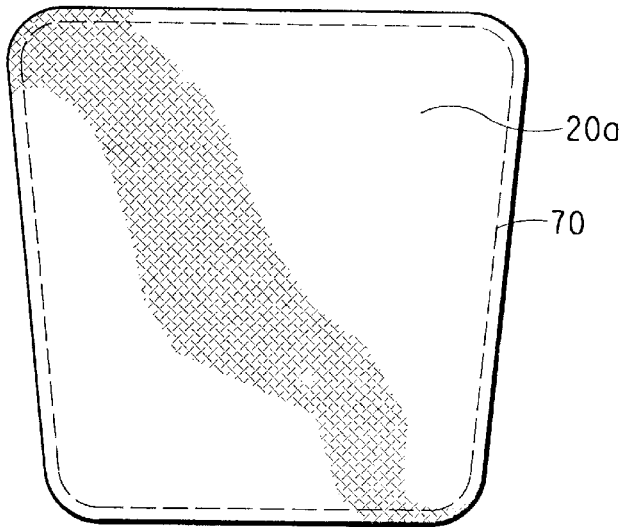
FIG. 4 shows a plan view of the top of a seat cushion covered with a stretch slipcover of the invention.

FIG. 4 is a plan view of the top of a seat cushion covered with a stretch slipcover of the invention. In the illustrated embodiment, the top portion 20*a* is connected to a perimeter skirt portion (not shown) by seam 70.

Figure 5:
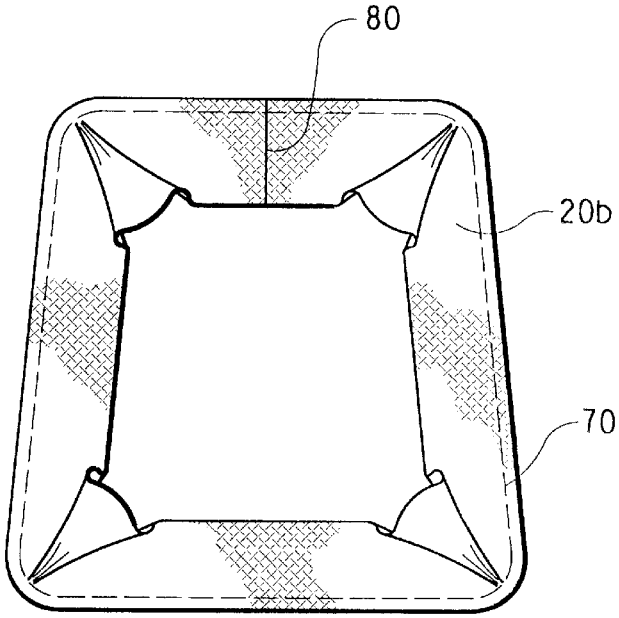
FIG. 5 shows a plan view of the bottom of a seat cushion covered with a stretch slipcover of the invention.

FIG. 5 is a plan view showing the bottom of a seat cushion covered with a stretch slipcover of the invention. The top portion (not shown) is connected by seam 70 to a perimeter skirt portion 20*b*.

Figure 6:
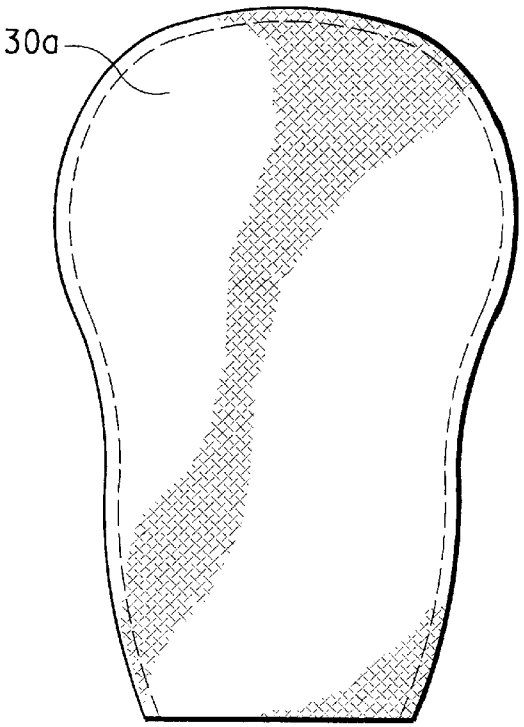
FIG. 6 is a pattern showing a front view of a stretch slipcover for a chair back.
Figure 7:
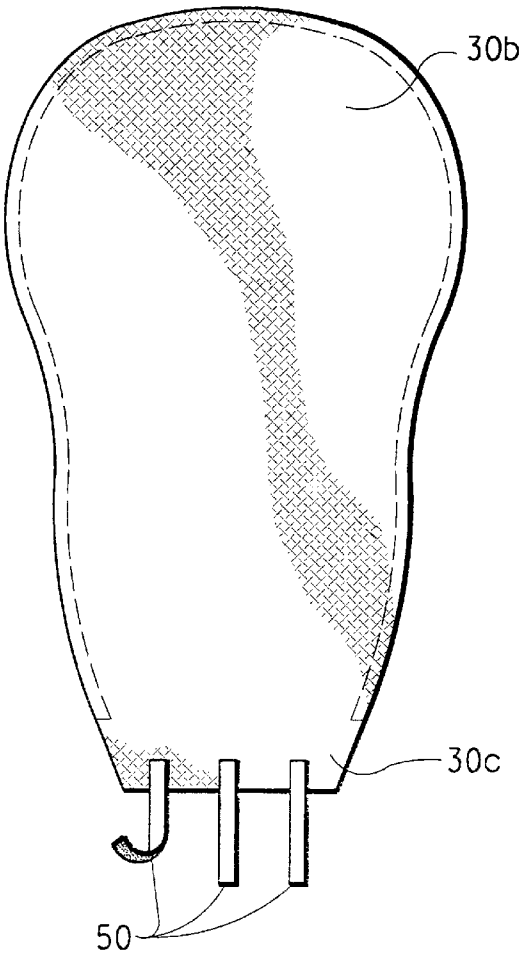
FIG. 7 is a pattern showing a back view of a stretch slipcover for a chair back.

FIGS. 6 and 7 are front and back elevation views, respectively, of a back cushion stretch slipcover of the invention. The front panel 30*a* of the stretch slipcover shown in FIG. 6 is seamed to the back panel 30*b* of the stretch slipcover shown in FIG. 7. Hook-and-loop fasteners ???so may optionally be attached to back panel 30*b*.

EXAMPLE 1

Stretch and recovery measurements obtained on five different fabrics, representing different types of construction and the use of fibers of varying levels of extensibility, are summarized in Table 1. Details of the method used to obtain these measurements follows: Tensile properties of the example fabrics were determined by standard Instron methods. Sample preparation involved taking a sample 3" wide and 8 inches in length, which was cut either parallel to the WD direction or the XD direction, and then sewn into a loop to give a gague length of 3" when placed around two stainless steel rods of ⅜" diameter which were attached to opposite ends of the jaws on the Instron.

The initial tensile analysis consisted of determining the tensile strain (% fabric extension) as a function of applied load from 0 lbs.-force to 15 lbs.-f, and then again as the load was decreased from 15 lbs.-f to 0 lbs.-f. Before the strain was recorded as shown in Table 1, the sample was exercised from 0-15 lbs.-f. two times. Thus, the data reported represent $3^{rd}$ cycle stretch and recovery behaviour. In Table 1, the % fabric extension at specific applied loads is given in order to differentiate the stretch characteristics of the fabrics in perpendicular directions. In Table 3, the fabrics with stretch of 25% or greater in at least two perpendicular directions are analyzed as a function of recovery force.

TABLE 1

| Fabric | % Extens. @ 5 lb. Load WD | % Extens. @ 10 lb. Load WD | % Extens. @ 15 lb. Load WD | % Extens. @ 5 lb. Un-Load WD | % Extens. @ 10 lb. Un-Load WD |
|---|---|---|---|---|---|
| Non-extensible Knit (1) | 24.3 | 31.9 | 35.9 | 32.3 | 34.9 |
| Extensible Knit (2) | 115.5 | 134.3 | 144.4 | 133.8 | 141.9 |
| Non-extensible Woven (3) | 6.4 | 7.6 | 8.4 | 7.5 | 7.9 |
| 1-way Stretch Woven (4) | 8.2 | 9.4 | 10.1 | 8.9 | 9.5 |
| 2-way Stretch Woven (5) | 59.6 | 76.0 | 83.3 | 73.2 | 81.3 |
| | % Extens. @ 5 lb. Load XD | % Extens. @ 10 lb. Load XD | % Extens. @ 15 lb. Load XD | % Extens. @ 5 lb. Un-Load XD | % Extens. @ 10 lb. Un-Load XD |
| Non-extensible Knit (1) | 154.7 | 169.8 | 178.0 | 171.9 | 176.2 |
| Extensible Knit (2) | 104.8 | 127.6 | 139.3 | 127.7 | 136.7 |

TABLE 1-continued

| | | | | | |
|---|---|---|---|---|---|
| Non-extensible Woven (3) | 6.5 | 7.7 | 8.5 | 7.2 | 7.9 |
| 1-way Stretch Woven (4) | 77.6 | 93.4 | 100.3 | 90.9 | 98.3 |
| 2-way Stretch Woven (5) | 24.0 | 29.8 | 33.0 | 30.6 | 32.3 |

Notes:
WD Warp direction
XD Perpendicular to warp direction
(1) Polyester circular knit fabric with a course count of 38 and wales count of 38. Basis weight = 5.9 oz/yrd$^2$.
(2) Cotton circular knit fabric with a course count of 60 and wales count or 35 with 70 denier Lycra ® brand elastane fed in the course direction. Basis weight = 7.2 oz/yrd$^2$.
(3) 100% Cotton woven fabric. Plain weave construction. 134 ends/inch in the warp and 58 picks/inch in the fill direction. Basis weight = 7.7 oz/yrd$^2$.
(4) 3X1 Twill woven fabric. 150 denier textured polyester/40 denier covered Lycra ® brand elastane warp 92 ends/inch in the warp direction. 20/1 cotton yarn filling at 90 ends/inch. Basis weight = 8.1 oz/yrd$^2$.
(5) 3X1 Twill woven fabric. 150 denier textured polyester/40 denier covered Lycra ® brand elastane warp 126 ends/inch in the warp direction. 16/1 cotton yarn core-spun with 40 denier Lycra ® brand eleastane filling at 76 ends/inch. Basis weight = 11.0 oz/yrd$^2$.

EXAMPLE 2

Table 2 summarizes the performance, on two different chair designs, of stretch slipcovers made from each of the fabrics described above.

TABLE 2

| Fabric | Form fit without wrinkles | Slippage after casual use | Assymetric or undesireable distortion of fabric pattern |
|---|---|---|---|
| | Office Chair | | |
| Non-extensible Knit (1) | Yes | Yes | No |
| Extensible Knit (2) | Yes | No | No |
| Non-extensible Woven (3) | No | Yes | No |
| 1-way Stretch Woven (4) | No | No | Yes |

TABLE 2-continued

| Fabric | Form fit without wrinkles | Slippage after casual use | Assymetric or undesireable distortion of fabric pattern |
|---|---|---|---|
| 2-way Stretch Woven (5) | Yes | No | No |
| | Banquet Chair | | |
| Non-extensible Knit (1) | Yes | Yes | No |
| Extensible Knit (2) | Yes | No | No |
| Non-extensible Woven (3) | No | Yes | No |
| 1-way Stretch Woven (4) | No | No | Yes |
| 2-way Stretch Woven (5) | Yes | No | No |

Based on the criteria listed in Table 2, the only fabrics that deliver acceptable stretch slipcover performance are the elastified knit and the 2-way stretch woven.

Comparison of Table 2 with Table 1 shows that both types of fabrics that performed successfully, i.e. the elastified knit and the 2-way stretch woven, exhibit greater than 30% extension in directions parallel and perpendicular to the warp direction. These fabrics have sufficient available extension in both directions to readily to don the stretch slipcovers as well as sufficient recovery force to cause the fabric to conform, without wrinkling, to the shape of the surface to which it is applied.

The non-elastified knit is also characterized by similarly large bi-directional stretch properties, but is distinguished from the elastified knit and 2-way stretch woven fabrics by its recovery force characteristics, as shown in Table 3 below. While exhibiting sufficient bi-directional extension for donning, the non-elastified knit has adequate recovery force in only one direction. The result is that wrinkles form, as seen in a direction that is perpendicular to the direction of insufficient (<200 grams) recovery force.

TABLE 3

| Fabric | WD Recovery Force @ 25% Elongation | XD Recovery Force @ 25% Elongation | WD Recovery Force @ 40% Elongation | XD Recovery Force @ 40% Elongation |
|---|---|---|---|---|
| Non-elastified Knit | 1111.32 g | 68.04 g | ‡ | 142.88 g |
| Elastified Knit | 226.80 g | 272.16 g | 396.90 g | 403.20 g |
| 2-way Stretch Woven | 514.08 g | 1088.6 g | 966.2 g | * |

Notes:
‡The non-elastified knit could not be analyzed at 40% elongation in the WD direction, since the fabric only exhibits a ~36% stretch in that direction, as shown in Table 1.
*The 2- way stretch woven could not be analyzed at 40% elongation in the XD direction, since the fabric only exhibits ~33% stretch in that direction, as shown in Table 1.

The 1-way stretch woven exhibits insufficient extension in the warp direction to allow donning of form-fitting stretch slipcovers, even though extension in the perpendicular direction is more than adequate. The non-elastified woven lacks adequate extension in either direction to allow donning of form-fitting stretch slipcovers.

What is claimed is:

1. A stretch slipcover for a chair, consisting essentially of: a fabric having greater than 30% extension under 15 lbs applied load in directions parallel and perpendicular to a warp direction of the fabric, the fabric comprising a front portion and side portions for covering a front surface and at least part of side surfaces of a back cushion of the chair, wherein the fabric has a minimum recovery force of 200 grams at 25% extension in directions parallel and perpendicular to a warp direction of the fabric.

2. A stretch slipcover for a chair, consisting essentially of: a fabric having greater than 30% extension under 15 lbs applied load in directions parallel and perpendicular to a warp direction of the fabric, the fabric comprising a front portion and side portions for covering a front surface and at least part of side surfaces of a back cushion of the chair, wherein the fabric comprises a long chain synthetic elastomer comprised of at least 85% by weight of a segmented polyurethane.

3. A stretch slipcover for a chair, consisting essentially of: a fabric having greater than 30% extension under 15 lbs applied load in directions parallel and perpendicular to a warp direction of the fabric, the fabric comprising a top portion and side portions for covering a too surface and at least part of side surfaces of a seat cushion of the chair, wherein the fabric has a minimum recovery force of 200 grams at 25% extension in directions parallel and perpendicular to a warp direction of the fabric.

4. A stretch slipcover for a chair, consisting essentially of: a fabric having greater than 30% extension under 15 lbs applied load in directions parallel and perpendicular to a wrap direction of the fabric, the fabric comprising a top portion and side portions for covering a top surface and at least part of side surfaces of a seat cushion of the chair, wherein the fabric comprises a long chain synthetic elastomer comprised of at least 85% by weight of a segmented polyurethane.

* * * * *